US008278573B2

(12) United States Patent
Chuang

(10) Patent No.: US 8,278,573 B2
(45) Date of Patent: Oct. 2, 2012

(54) CIRCUIT BREAKER FOR USE IN HIGH POWER SYSTEM AND THE POWER SYSTEM

(75) Inventor: Chia-Ming Chuang, Taipei (TW)

(73) Assignee: Atieva, Inc., Redwood City, CA (US)

( * ) Notice: Subject to any disclaimer, the term of this patent is extended or adjusted under 35 U.S.C. 154(b) by 138 days.

(21) Appl. No.: 12/972,516

(22) Filed: Dec. 19, 2010

(65) Prior Publication Data

US 2011/0147174 A1 Jun. 23, 2011

(30) Foreign Application Priority Data

Dec. 18, 2009 (CN) ..... 2009 1 0259529

(51) Int. Cl.
*H01R 33/96* (2006.01)

(52) U.S. Cl. ..... 200/17 R; 200/50.28; 200/51.09; 200/334

(58) Field of Classification Search ..... 200/17 R, 200/51 R, 43.02, 50.01, 321, 50.28, 50.31, 200/51.09, 51.11, 51.12, 318, 322, 334
See application file for complete search history.

(56) References Cited

U.S. PATENT DOCUMENTS

| | | | | |
|---|---|---|---|---|
| 6,441,708 | B1 * | 8/2002 | Rodriguez et al. | 335/172 |
| 6,943,652 | B2 * | 9/2005 | Rodriguez et al. | 335/6 |
| 2002/0050887 | A1 * | 5/2002 | Rodriguez et al. | 335/167 |
| 2003/0206092 | A1 * | 11/2003 | Rodriguez et al. | 337/79 |
| 2005/0128034 | A1 * | 6/2005 | Rodriguez et al. | 335/167 |

* cited by examiner

*Primary Examiner* — Gary F. Paumen

(57) ABSTRACT

A high power system provided with a circuit breaker is disclosed, in which the circuit breaker controls the electrical connection in the system. The circuit breaker has a switch device and a connecting device. Two conductive terminals provided in the connecting device are spaced apart from each other and connected to a power source. The connecting device is equipped with a safety latch for transmitting a signal demanding the establishment of electrical connection to an interrupting control circuit. A conductive element provided in the switch device is electrically connected to the conductive terminals of the connecting device, and then a latch releasing element provided in the switch device drives the safety latch to activate the interrupting control circuit, so as to permit power transmission in the high power system.

19 Claims, 16 Drawing Sheets

CIRCUIT BREAKER FOR USE IN HIGH POWER SYSTEM AND THE POWER SYSTEM

FIELD OF THE INVENTION

The present invention relates to a circuit breaker, and more particularly, to a circuit breaker for use in a high power system.

DESCRIPTION OF THE RELATED ART

Electric-powered vehicles or some power facilities may either consume or allow passage of electric power at a voltage or current level as high as several hundreds volts or several tens amperes. Such a high voltage or current level would potentially risk the safety of personnel who perform engineering or maintenance works. Therefore, one of the indispensable issues in this technical field is as to how the power transmission is to be cut off in an efficient and safe way.

A qualified power cut-off design should protect personnel from electric shock hazards to ensure safety, while taking into account the convenience in installment and maintenance for saving time and manpower. In particular, a faulty supply of power before the completion of a maintenance work is absolutely impermissible. In addition, it is preferred to provide an insulated water-tight environment for an interrupting means of a power system that supplies a high level of voltage or current, so as to offer higher safety level.

A conventional safety breaker design, as shown in FIGS. 1-3, includes a circuit breaker 1 connected in series to a high power system having an interrupting control circuit (not shown). The circuit breaker 1 includes a switch device 11 and a connecting device 12, in which the switch device 11 includes a body 111 and lever 112. The body 111 has a conductive element 113 provided with a conductive plug. The connecting device 12 includes two conductive terminals 121 disposed within separate receptacle holes. The conductive terminals 121 correspond to the conductive plug and are accommodated by a housing 124. The two conductive terminals 121 are spaced apart from each other and connected in series to a power source, respectively.

The connecting device 12 is further provided with a fixed axial pin 123 protruding therefrom and a safety latch 122. The safety latch 122 is configured by disconnecting a circuit to the interrupting control circuit and embedding both ends within separate holes. The switch device 11 is formed with an arc-shaped guide slot 1122 for slidably receiving the fixed axial pin 123 and a latch releasing element 114 corresponding to the safety latch 122. The latch releasing element 114 is in the form of a metal wire located aside and cooperating with the lever 112. In addition, a positioning pin 1123 protrudes from the body 111 of the switch device in a manner corresponding to a slide slot 1121 formed in the lever 112.

In order to attach the switch device 11 to the connecting device 12, the arc-shaped guide slot 1122 of the lever 112 of the switch device 11 is first registered to the fixed axial pin 123 of the connecting device 12, so that the conductive element 113 of the switch body 111 is registered to the conductive terminals 121 of the connecting device 12. The lever 112 is then rendered to rotate clockwise along the positioning pin 1123, so that the arc-shaped guide slot 1122 is rotated along the fixed axial pin 123 until the switch device 11 is coupled to the connecting device 12. The connection of the conductive element 113 to the conductive terminals 121 results in a substantial closed circuit in the high power system, but there remains no power coming from the power source due to the action of the interrupting control circuit.

Finally, when the lever 112 is rotated to a position indicated by the broken line in FIG. 3, where the lever 112 is generally parallel to the body 111 of the switch device 11, the lever 112 is pushed along the arrowed direction until the slide slot 1121 and the arc-shaped guide slot 1122 of the lever 112 arrive at the positions shown by the solid lines as guided by the positioning pin 1123 and the fixed axial pin 123. At this time, the positioning pin 1123 is engaged at its flange with an enlarged end of the slide slot 1121, so as to perfectly position the switch device 11 in the connecting device 12. Following the movement of the lever 112, the latch releasing element 114 advances into the safety latch 122, whereby the interrupting control circuit receives a signal demanding the establishment of electrical connection and allows the power source of the high power system to supply power.

During maintenance, a technician may push the lever 112 outwardly in a reverse direction opposite to the arrowed direction shown in FIG. 3, by which the latch releasing element 114 is rendered away from the safety latch 122 and drive the interrupting control circuit to terminate the power supply from the power source of the high power system. The maintenance technician may further rotate the lever 112 to detach the switch device 11 therefrom as shown in FIGS. 1 and 2, so as to disconnect the power transmission line and cut off the power transmission in the high power system and, hence, provide safety protection for the system.

However, the attaching and detaching operations of the switch device 11 involve rotating and then pushing/drawing the lever 112 as guided by the positioning pin 1123 and the axial pin 123. The rather complicated design of this type remarkably increases the requirements on the manufacture processes and the precision of products, resulting in a limited manufacturing yield and an increase in the manufacture cost. This is especially true for the switch device 11 which is considered to be a consumable material.

Further, the circuit breaker 1 is not equipped with a waterproof design and could cause a safety risk when used in an outdoor application, such as in an electric-powered vehicle. In addition, since the latch releasing element 114 and the safety latch 122 are perpendicularly oriented to the conductive element 113 and conductive terminals 121, and since the latch releasing element 114 and the safety latch 122 protrude outwardly from the body 111 and the connecting device 12, it is scarcely possible to provide watertight sealing for the circuit breaker even if the conductive element 113 and the conductive terminals 121 are of waterproof structures. In the worst-case scenario, short-circuiting may occur as the conductive element 113 is connected to the conductive terminals due to seepage of water into the safety latch 122, and this would endanger the safety of personnel performing maintenance works.

Moreover, the switch device 11 will be detached from the connecting device 12 and exposed to environmental moisture and dirt during a maintenance procedure. As a result, the electrical resistance of the conductive element 113, as well as the contact resistance thereof with the connecting device 12, may undesirably increase due to contamination or rust occurring at its contact points with the connecting device 12. When the switch device 11 is coupled back to the connecting device 12, a large amount of heat may be generated between the conductive element 113 and the conductive terminals 121, potentially causing breakdown of the circuit breaker and risking the safety of personnel and property. If the circuit breaker is utilized in an electric vehicle, it is further preferred in terms of safety consideration that the power transmission be cut off in case the vehicle accidentally speeds up or even overturns due to an accident or other causes.

Therefore, there exists a need for a circuit breaker which is relatively simple in terms of structure, is user friendly and has a waterproof design, so as to provide better protection to the working personnel and to a high power system and the accompanying facilities. The present invention provides the best solution in response to the need.

SUMMARY OF THE INVENTION

Accordingly, a purpose of the present invention is to provide a circuit breaker for use in a high power system, which is relatively simple in terms of structure and has a waterproof design, thereby enhancing product safety.

Another purpose of the invention is to provide a circuit breaker for use in a high power system, which has a simple structure with low manufacture cost.

It is still another purpose of the invention to provide a circuit breaker for use in a high power system, which is so user friendly and ergonomic as to enhance the operation efficiency.

It is still another purpose of the invention to provide a circuit breaker for use in a high power system, which is provided with a safety sensor unit for improving self-protection ability.

It is still another purpose of the invention to provide a high power system adaptable for outdoor operation and maintenance.

It is yet still another purpose of the invention to provide a high power system adaptable for enhancing the safety of the power system upon detection of safety risks present in the environment.

The circuit breaker according to the invention is adapted for being connected in series to a high power system having an interrupting control circuit. The circuit breaker comprises a switch device and a connecting device. The switch device includes: a body formed with a rest portion; a conductive element disposed in the body and having two protruding conductive plug parts; and a latch releasing element disposed in the body. The connecting device includes: a housing; a socket having two receptacle holes formed in the housing, the receptacle holes being each provided inside with a conductive terminal for receiving and engaging the conductive plug part of the conductive element and for being connected in series to the high power system; a safety latch adapted for activating the interrupting control circuit upon being driven by the latch releasing element, when the switch device is coupled to the connecting device to establish an electrical circuit between the conductive terminals and the conductive element; and a pressing holder disposed on the housing and adapted for pivoting about a pivot axis with respect to the housing, the pressing holder having a snap portion for being received by the rest portion in such a manner that the switch device is forcedly pressed against and combined with the connecting device. One of a portion of the body of the switch device where the conductive element is disposed and a portion of the housing of the connecting device where the socket is formed is configured in the form of a protrusion, while the other is configured in the form of a recess corresponding to the protrusion, and wherein the protrusion is sleeved outside with a flexible seal.

Since the switch device and the connecting device include a protrusion and a recess, respectively, and since the protrusion is provided with a flexible seal, the electrical circuit between the switch device and the connecting device are reliably maintained in a water-tight environment, thereby ensuring that the power system is suited for outdoor applications. In addition, since the latch releasing element of the switch device together with the conductive element are protected against water seepage by the flexible seal, the safety of the circuit breaker and the power system can be facilitated even more. Further, during a dissembling process, a maintenance technician may simply pull off the pressing holder to release the switch device from the connecting device and slightly separate both devices from each other, so as to allow the interrupting control circuit to receive a signal demanding interruption of electrical connection, thereby cutting off the power supply from the power source of the high power system and ensuring personnel safety. Next, the maintenance technician may completely detach the switch device from the connecting device to open the circuit between the connecting device and the power source and the high power system. During an assembling process, the maintenance technician may press the switch device onto the connecting device with his palm and further secure the pressing holder in position with fingers. Given that the operations described above apparently meet the ergonomic requirements, together with the fact that the inventive circuit breaker has a simple structure, the invention achieves the purposes of being user friendly, being cost effective and improving working safety, as described above.

BRIEF DESCRIPTION OF THE DRAWINGS

The above and other objects, features and effects of the invention will become apparent with reference to the following description of the preferred embodiments taken in conjunction with the accompanying drawings, in which.

DETAILED DESCRIPTION OF THE INVENTION

Figure 1:
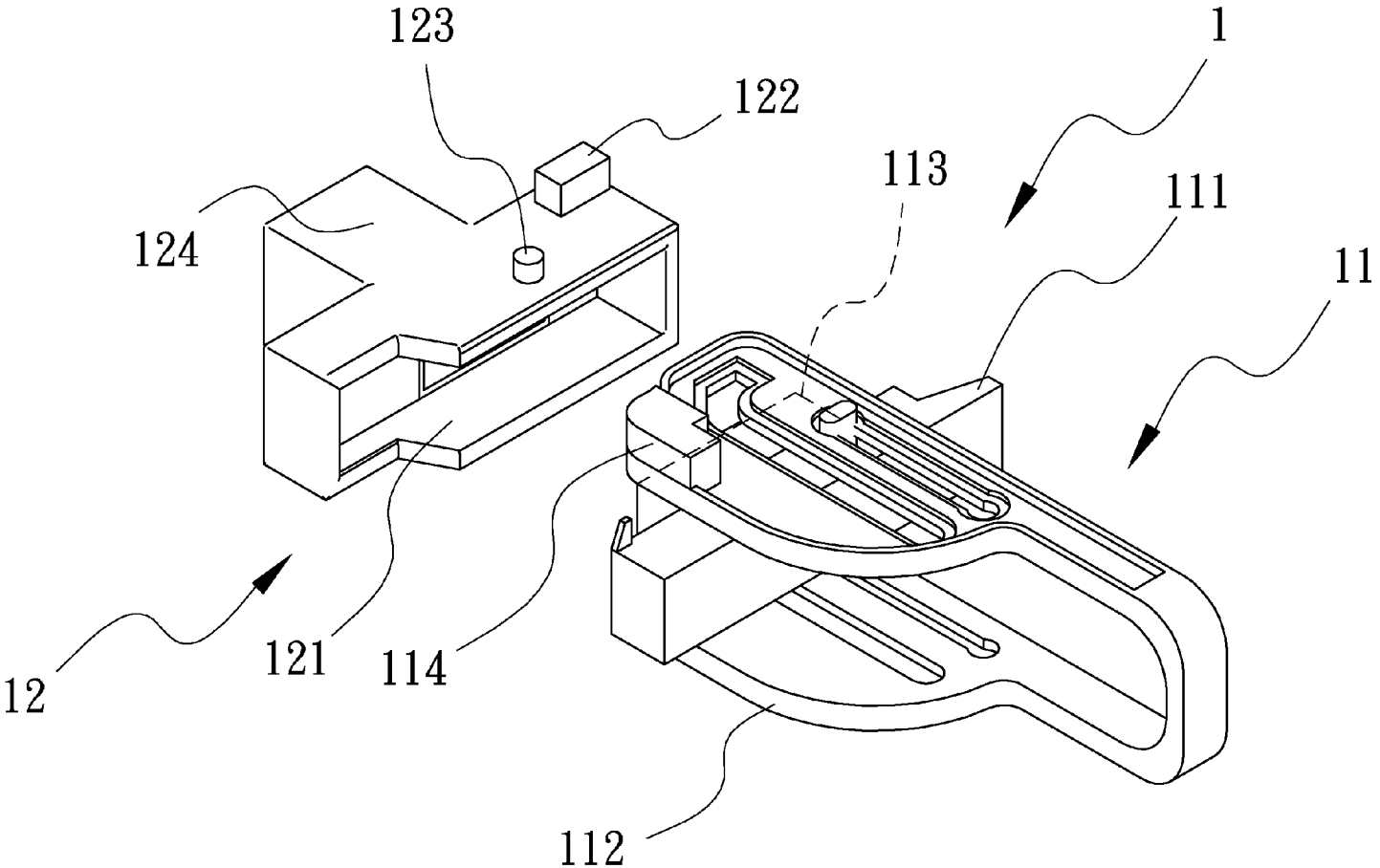
PRIOR ART FIG.1
FIG. 1 is a schematic diagram illustrating the structure of a conventional circuit breaker.
Figure 2:
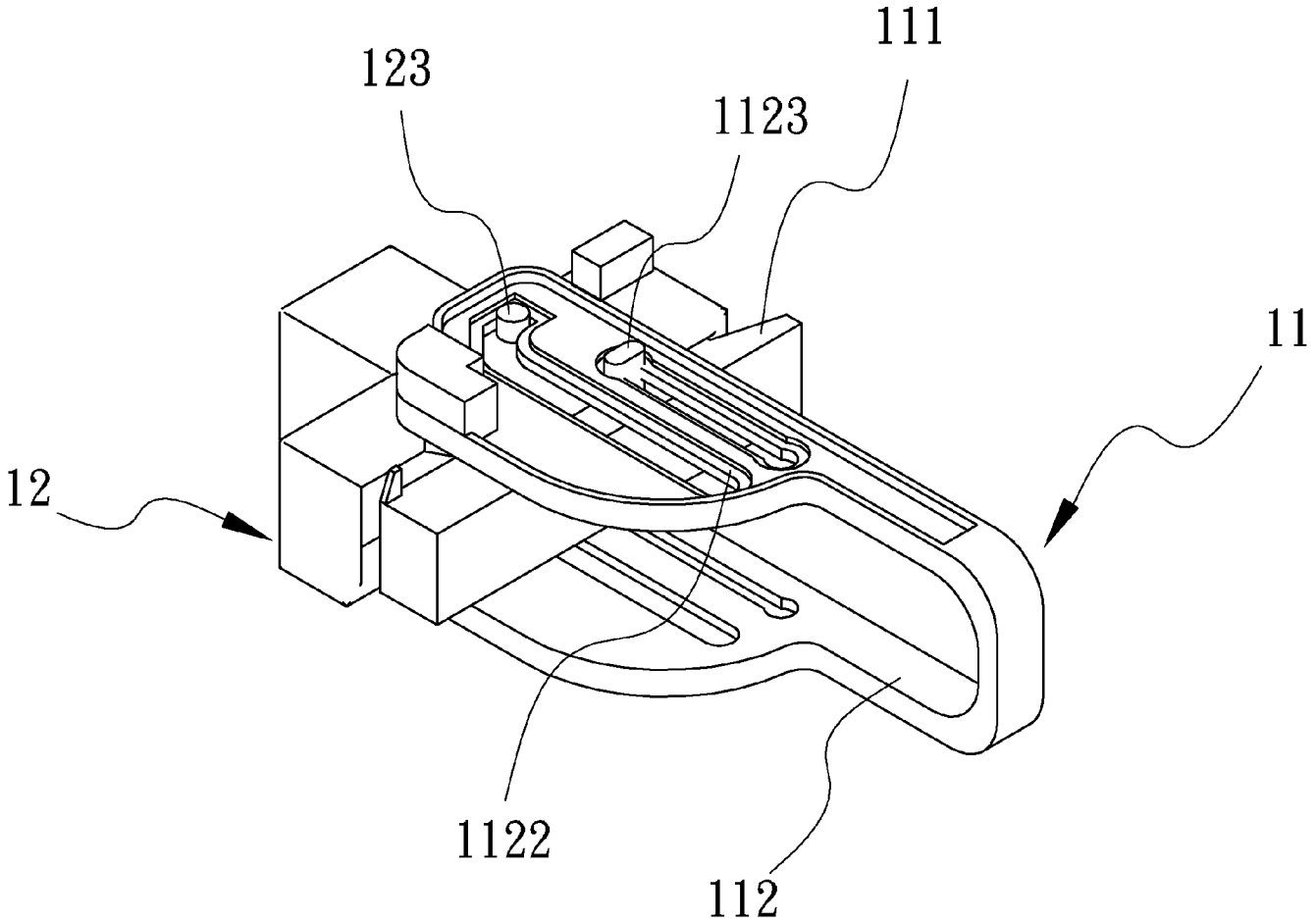
PRIOR ART FIG.2
FIG. 2 is a schematic diagram illustrating the state where the switch device shown in FIG. 1 is inserted into the connecting device.
Figure 3:
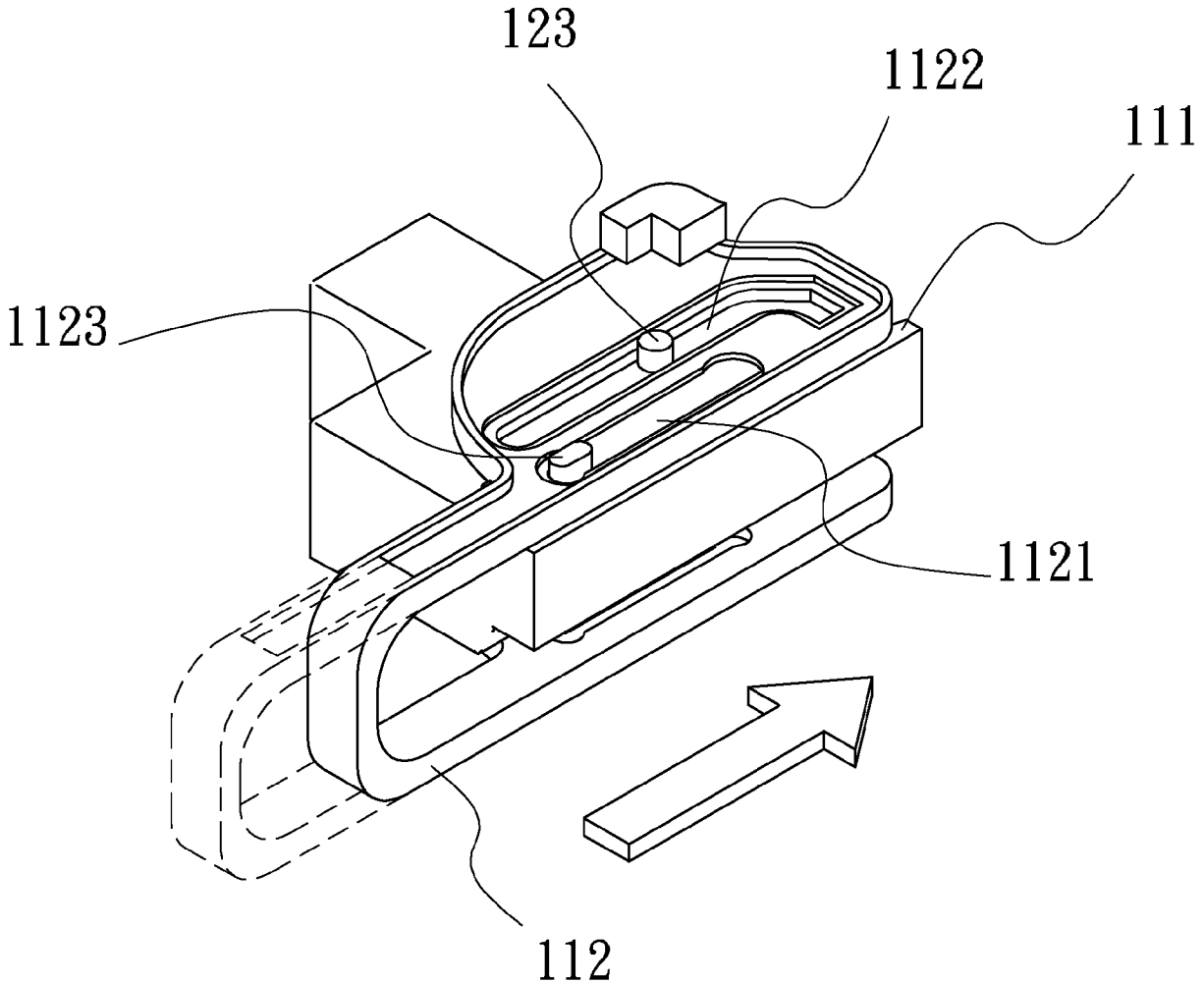
PRIOR ART FIG.3
FIG. 3 is a schematic diagram illustrating the state where the lever shown in FIG. 2 is rotated and pushed.
Figure 4:
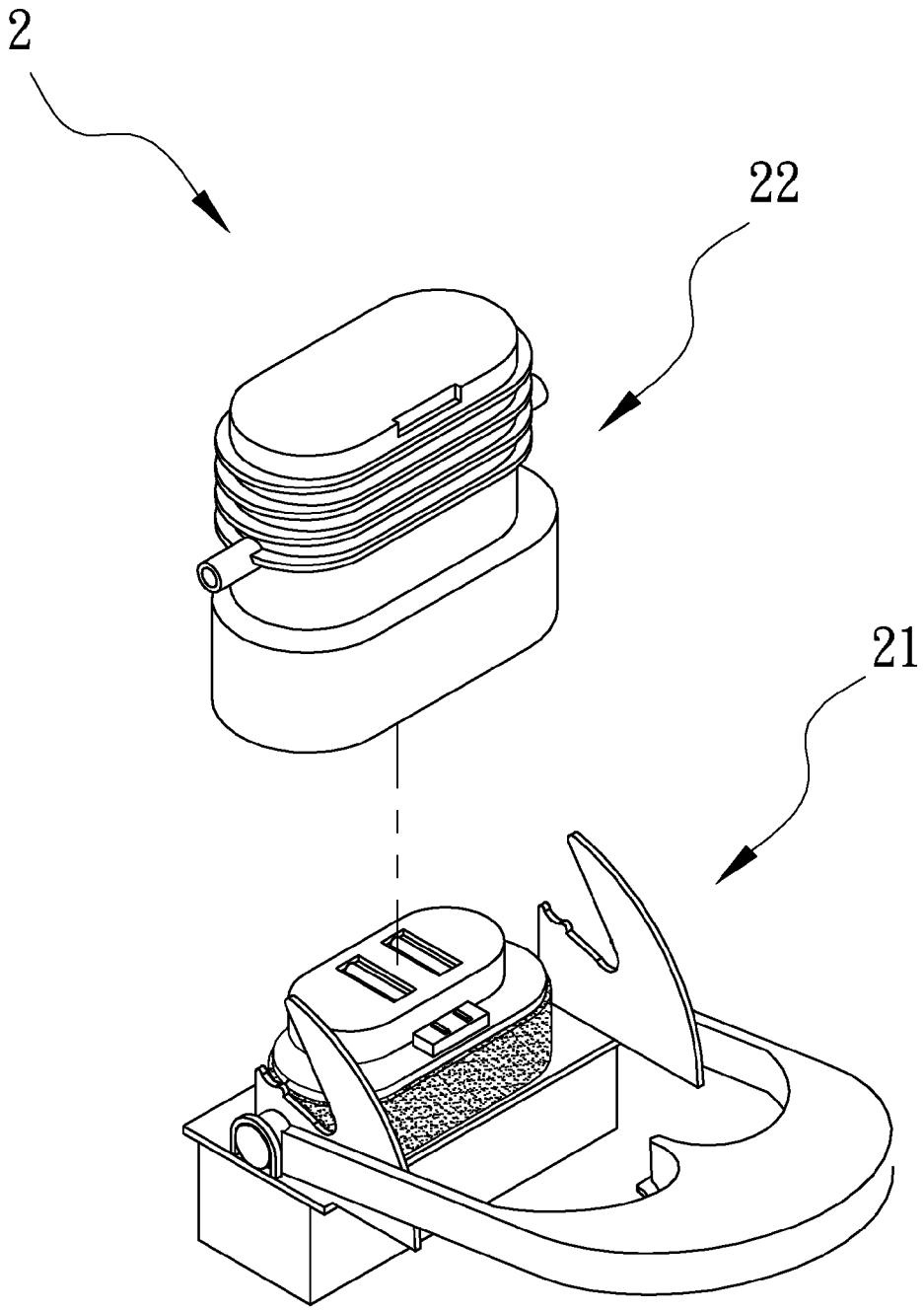
FIG. 4 is a schematic diagram illustrating a circuit breaker for use in a high power system according to the first preferred embodiment of the invention.

The circuit breaker according to the invention is particularly suitable for use in a high power system provided with an interrupting control circuit for controlling power transmission. As illustrated in FIG. 4, a circuit breaker 2 according to the first preferred embodiment of the invention primarily includes a switch device 21 and a connecting device 22. Together referring to FIGS. 5 and 6, the switch device 21 has a body 211, a conductive element 212, a latch releasing element 213 and lugs 214. The connecting device 22 primarily includes a housing 221, conductive terminals 222, a safety latch 223 and a pressing holder 224. The conductive element, latch releasing element, conductive terminals and safety latch are generally equivalent to their prior art counterparts in terms of functions, among which the safety latch 223 operates as an open circuit connected to an interrupting control circuit (not shown) and activates the interrupting control circuit upon being driven by the latch releasing element 213 of the switch device 21.

Figure 5:
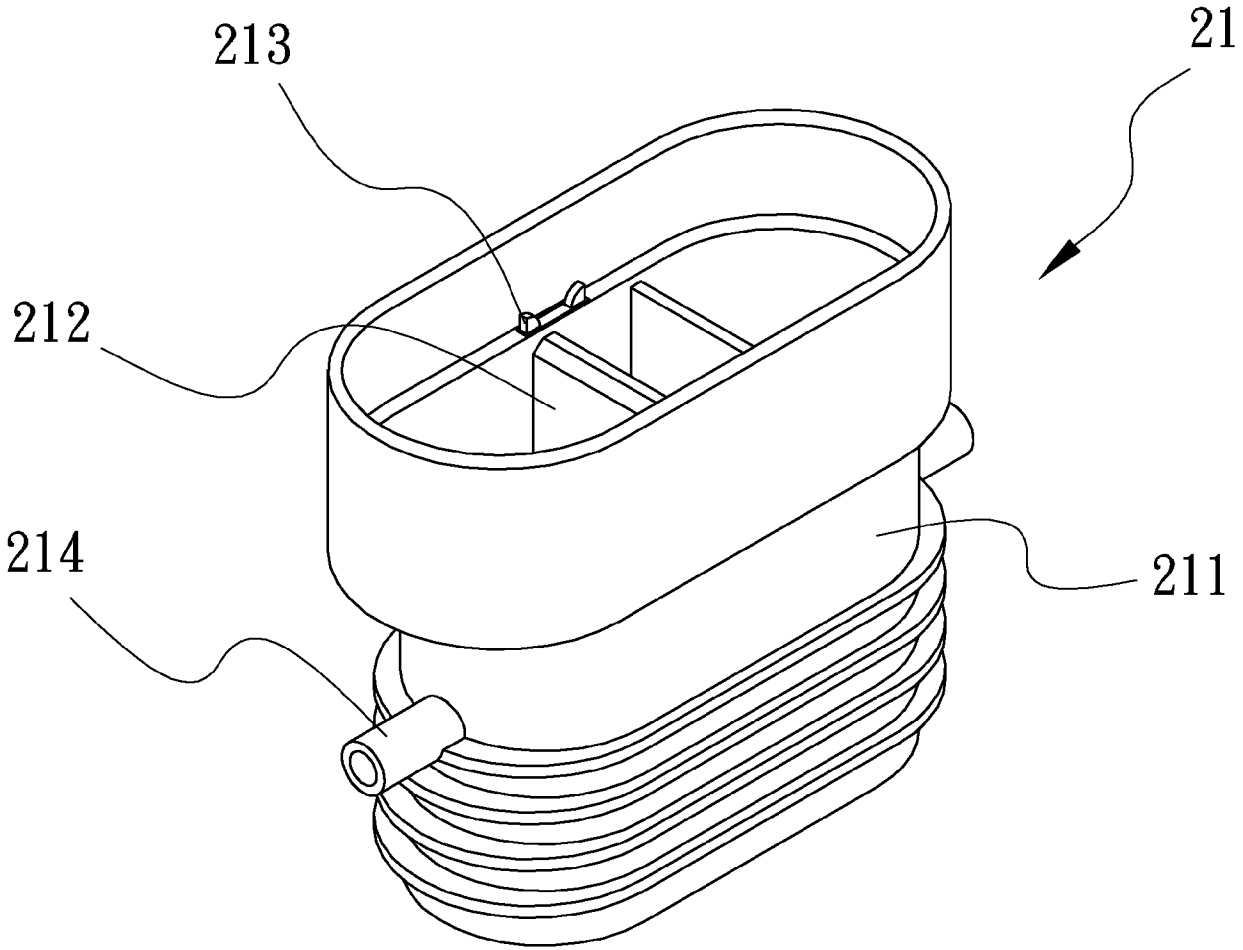
FIG. 5 is a schematic diagram showing the structure of the switch device shown in FIG. 4.
Figure 6:
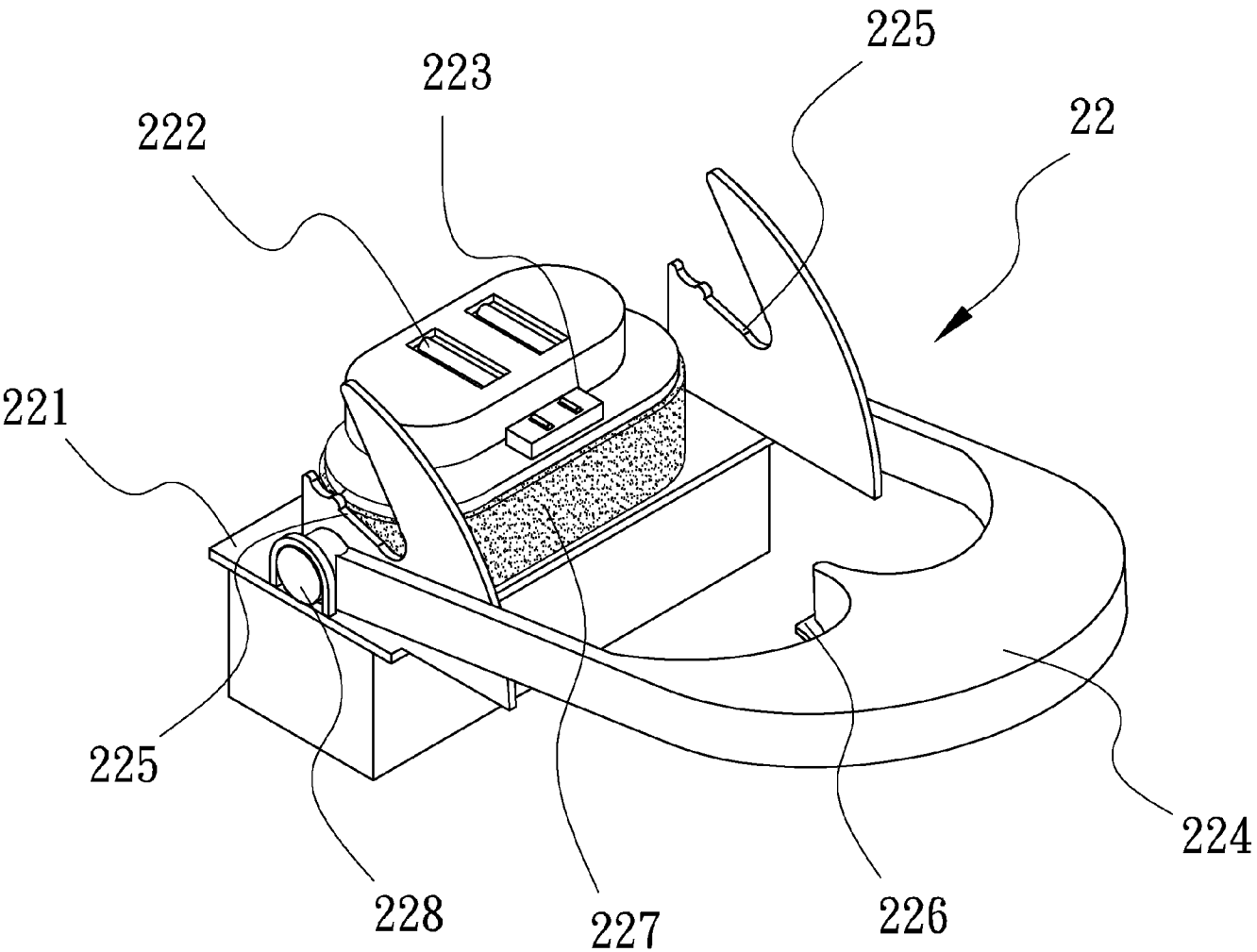
FIG. 6 is a schematic diagram showing the structure of the connect device shown in FIG. 4.

In this embodiment, the body 211 of the switch device 21 is made of insulation material and formed with a single opening oriented upwardly as shown in FIG. 5 and a recess oriented downwardly (not shown). Since the conductive terminals 222 of the connecting device 22 are connected to a power source, respectively, the conductive terminals 222 are disposed within separate receptacle holes formed by the housing 221 to constitute a socket with dual receptacle holes, thereby preventing unintentional touch of the conductive terminals by an operator. In this embodiment, the conductive terminals 222 may by way of example be those commercially available from Anderson Power Products (APP). Therefore, the conductive element 212 disposed within the body 211 of the switch device 21 according to this embodiment may by way of example be configured in the form of conductive blades located within the recess and functioning as two conductive plug parts corresponding to the receptacle holes for placing the two conductive terminals 222 in an electrically connected state.

In addition, the connecting device 22 according to this embodiment is formed at its bottom with a protrusion corresponding to the recess of the switch device 21. The socket and the conductive terminals 222, as well as the safety latch 223 located aside the socket, are disposed on the protrusion. The latch releasing element 213 is mounted within the recess of the switch device 21 in a manner corresponding to the safety latch 223. In this embodiment, the safety latch may by way of example be configured as two conductive wires electrically connected to the interrupting control circuit, respectively, so as to transmit a signal demanding the establishment of electrical connection to the interrupting control circuit as the conductive blade is brought in contact with the conductive wires. In comparison to the conductive terminals 222 and the conductive element 212 which should be of sufficient dimensions to tolerate the passage of high current, the safety latch 223 and the latch releasing element 213 illustrated in the form of small conductive blades are much smaller in size, so as to provide a size-based foolproof design for avoiding mis-assembly during the assembling of the switch device 21 with the connecting device 22.

In addition, the protrusion is sleeved with a rubber ring functioning as a flexible seal 227. Therefore, after the assembly of the switch device 21 and the connecting device 22, the body 211 of the switch device 21 and the housing 221 of the connecting device 22, assisted by the rubber ring, create a water-tight space with a waterproof rating of IP69K as measured by actual tests. The contact points between the conductive element 212 and the conductive terminals 222, as well as those between the latch releasing element 213 and the safety latch 223, are all located within the water-tight space, such that the inventive circuit breaker can be suitably used in outdoor environments, seashore areas and other humid or salty environments.

Figure 7:
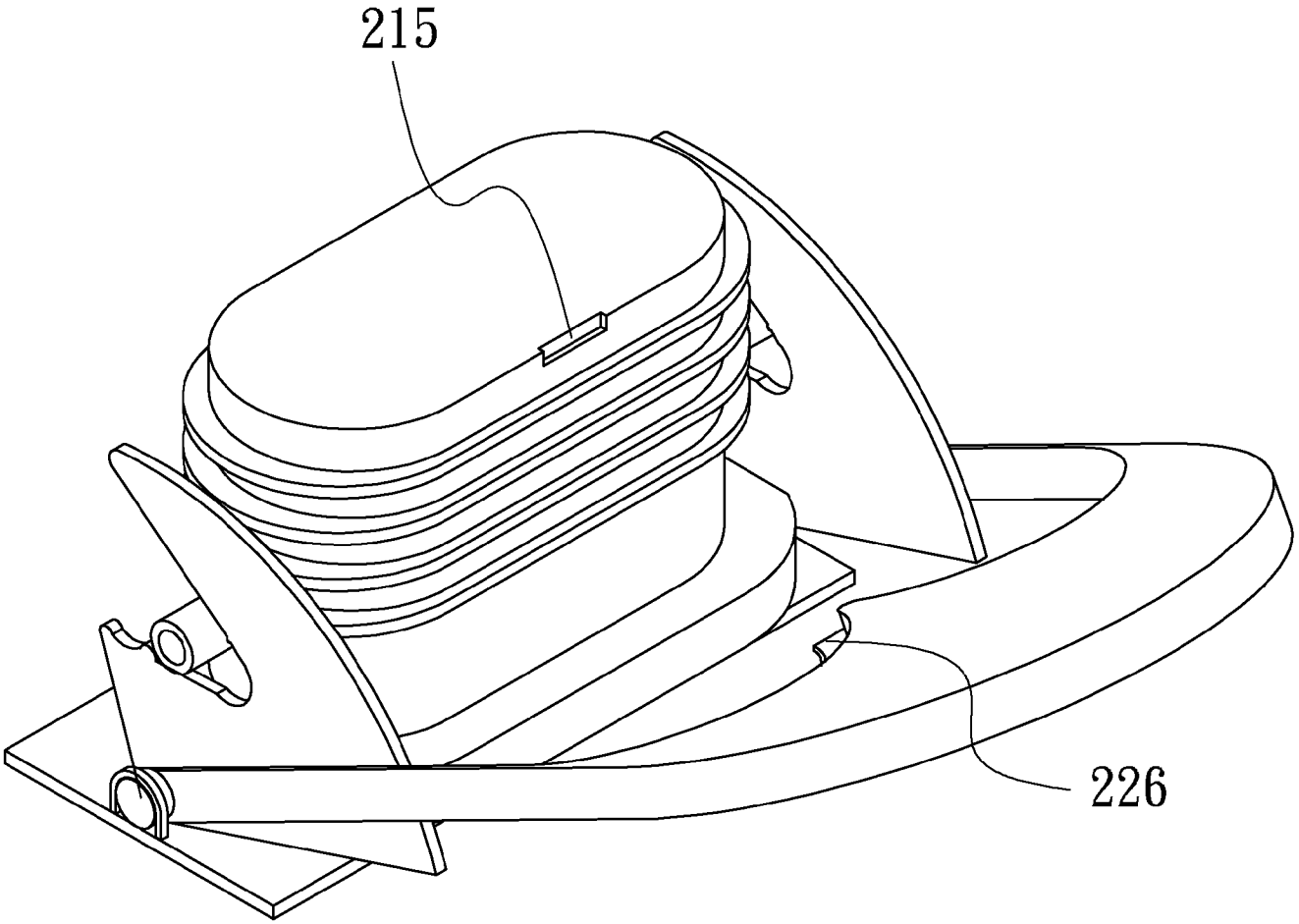
FIGS. 7 and 8 are schematic diagrams illustrating the state where the switch device shown in FIG. 4 is forced by the pressing holder to abut on and press against the connecting device.
Figure 8:
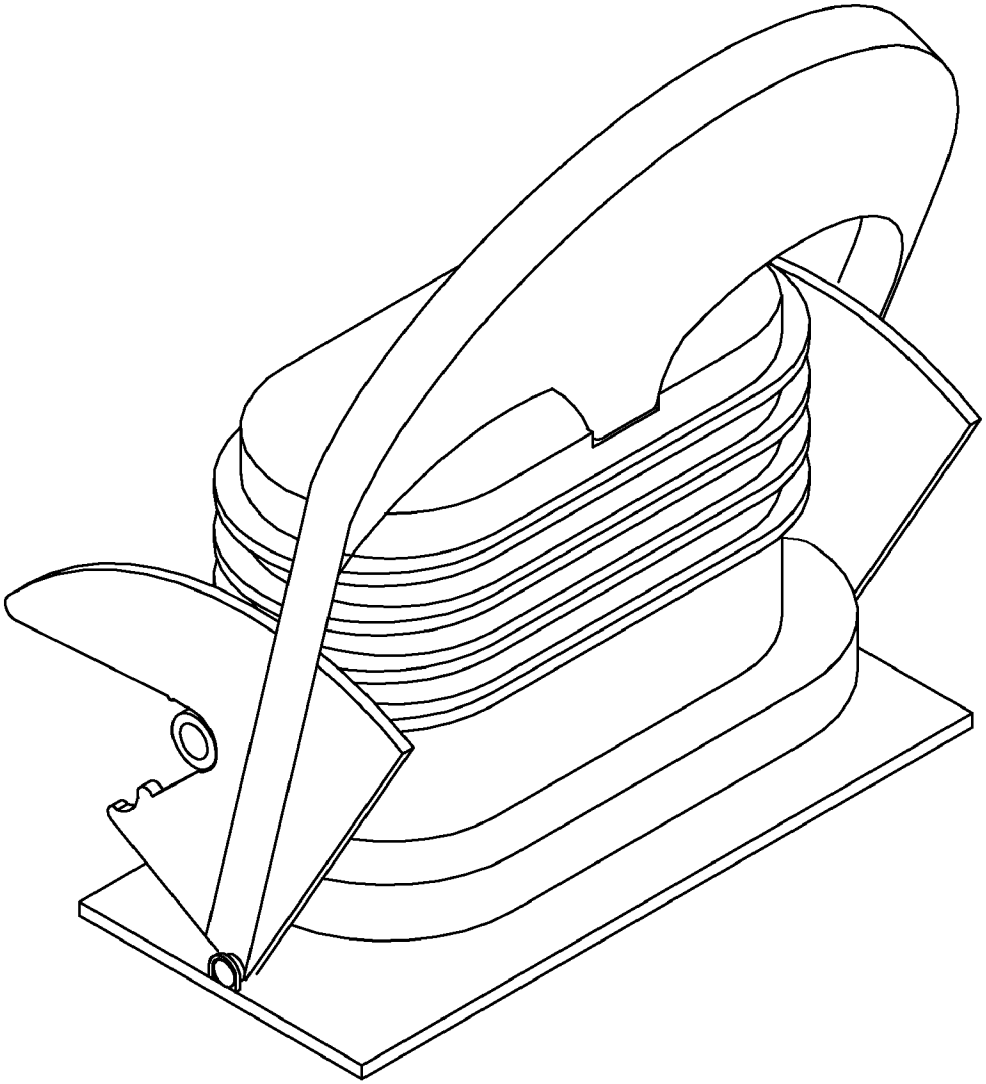

According to this embodiment, the body 211 of the switch device is laterally formed at both sides with a lug 214. The pressing holder 224 of the connecting device 22 is provided with two guide portions, each corresponding to a lug 214. In this embodiment, the guide portions may by way of example be configured in the form of tapered slots 225 shown in FIGS. 7 and 8. When the switch device 21 is sleeved onto the connecting device 22 and the lugs 214 are fitted into the tapered slots 225, an operator may pivot the pressing holder 224 about a pivot pin 228 with respect to the housing 221 of the connecting device, so that the switch device 21 is forcedly pressed against the connecting device 22 as guided by inclined edges of the tapered slots 225. By this way, the engagement of the conductive element 212 with the conductive terminals 222 and the engagement of the latch releasing element 213 with the safety latch 223 are rendered stable and reliable.

Next, as the pressing holder 224 is rotated to abut atop the switch device 21, a snap portion 226 downwardly extending from the pressing holder 224 is snapped into a rest recess 215 formed on the body 211 of the switch device. The snap-fit engagement serves to indicate the completion of the assembling on one hand, and prevents the pressing holder 224 from being unintentionally detached from the switch device 21 on the other hand. Especially, both of the pressing and snapping operations can be done with a single hand, simply by pressing the switch device 21 with elbow and palm, followed by holding and pivoting the pressing holder 224 in position with four fingers of the same hand. The operations are quite simple and meet the ergonomic requirement.

In this embodiment, when the switch device 21 is in a detached condition from the connecting device 22, the distance between the latch releasing element 213 and the safety latch 223 is larger than that between the conductive element 212 and the conductive terminals 222. Therefore, during the assembling of the circuit breaker, the conductive element 212 will be first brought in contact with the conductive terminals 222 to establish an electrical circuit. The safety latch 223 is brought into engagement subsequently so that the interrupting control circuit is activated in response to receipt of an indication of the establishment of the electrical circuit, thereby permitting power transmission in the high power system.

Figure 9:
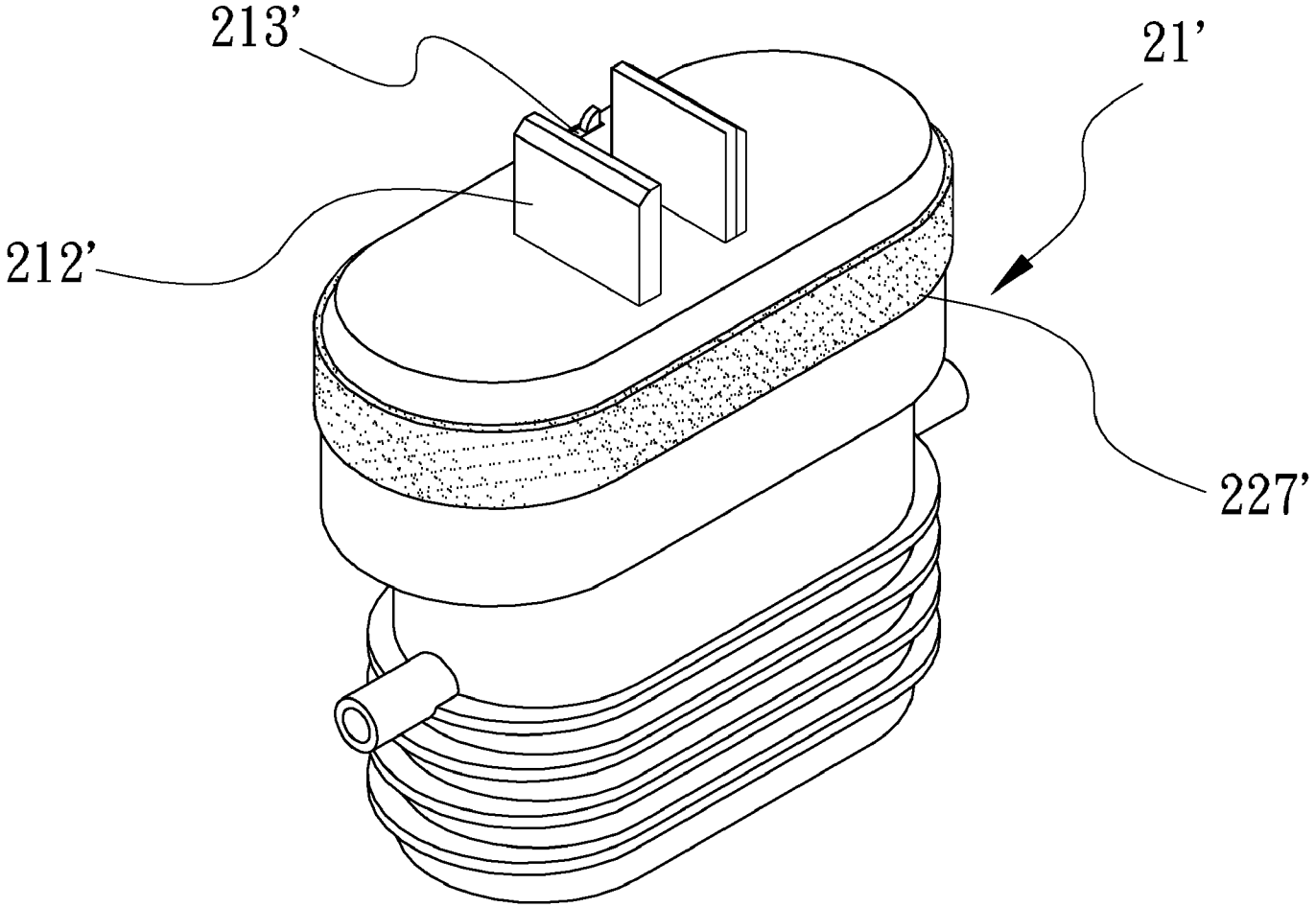
FIGS. 9 and 10 are schematic diagrams illustrating a circuit breaker for use in a high power system according to the second preferred embodiment of the invention.
Figure 10:
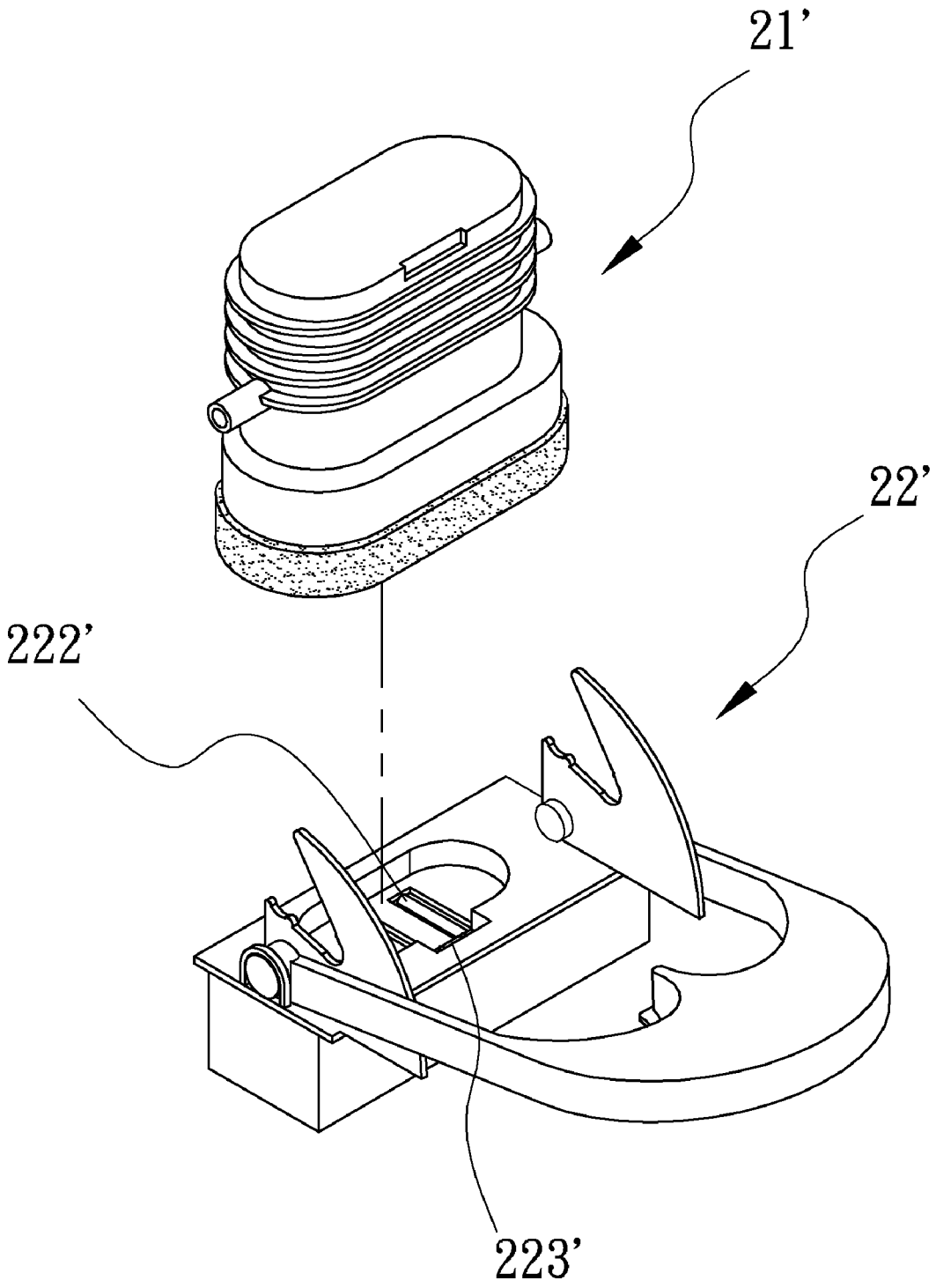

It is apparent to those skilled in the art that the recess is not necessarily disposed on the switch device and the protrusion is not necessarily disposed on the connecting device. As shown in FIGS. 9 and 10, a switch device 21' may be provided with a protrusion on which a conductive element 212' and a latch releasing element 213' are mounted, while the connecting device 22' is formed with a recess in which conductive terminals 222' and a safety latch 223' are disposed to constitute a socket. In this case, a flexible seal 227' is mounted on the protrusion of the switch device 21'.

Figure 11:
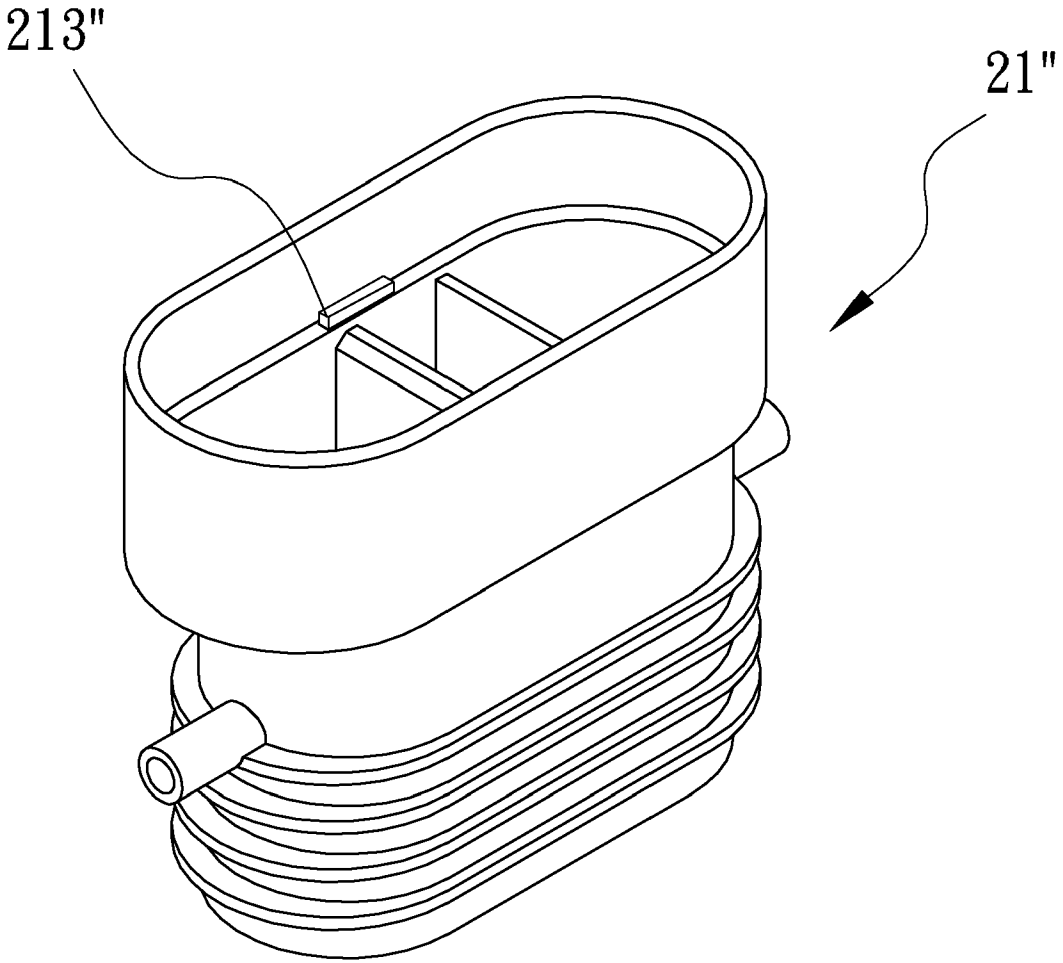
FIGS. 11 and 12 are schematic diagrams illustrating a circuit breaker for use in a high power system according to the third preferred embodiment of the invention.
Figure 12:
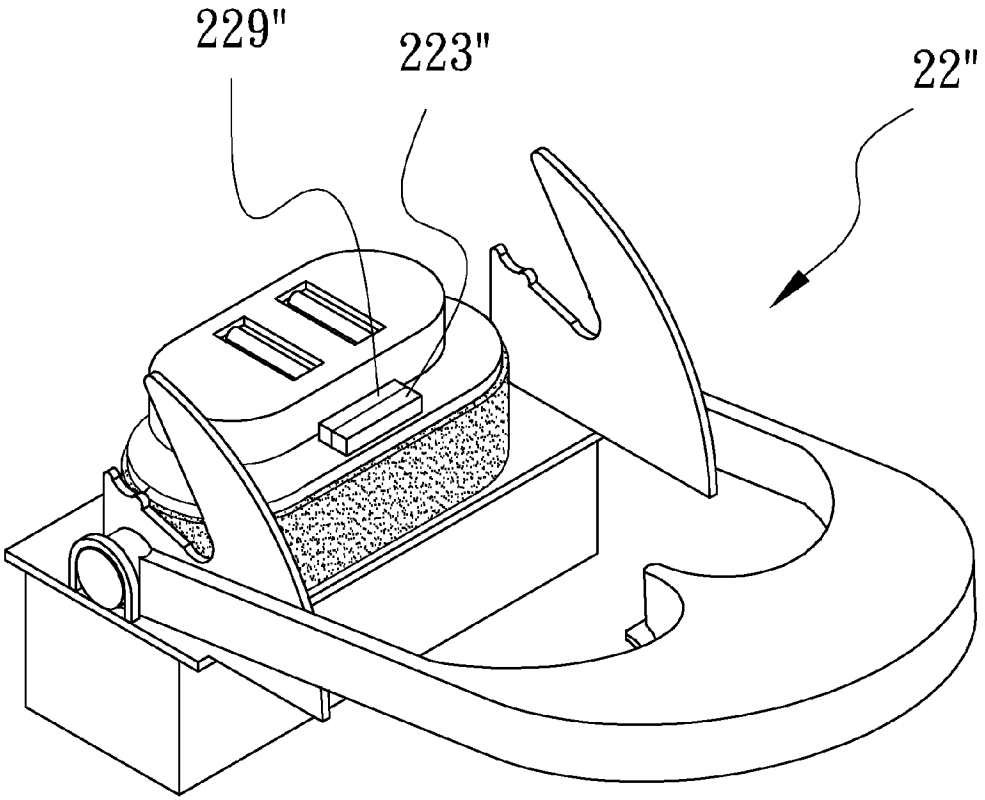

Further, the latch releasing element and the safety latch are unrestrictively illustrated in the previous embodiments as conductive blades and two conductive wires connected to the interrupting control circuit, respectively. According to the third preferred embodiment of the invention as shown in FIGS. 11 and 12, the latch releasing element 213" may by way of example be an abutting portion configured in the form of a small projecting portion. A safety latch 223" is a pressure-sensitive sensor adapted for transmitting an electrical signal to the interrupting control circuit upon being pressed by the latch releasing element 213", such that the interrupting control circuit is notified of the fact that the switch device 21" is assembled with the connecting device 22". Other sensing means, such as a combination of an optical sensor with a photo-interrupter, are also applicable in the invention.

Further, in order to protect the switch device from being rusted as a result of being contaminated or moistened during maintenance, thereby preventing the circuit breaker from generating heat or even being damaged due to an increased electrical resistance of the rusted contact points, the safety latch 223" according to this embodiment is provided aside with a safety sensor unit electrically connected to the safety latch 223". In this embodiment, the safety sensor unit may by way of example be a temperature sensor 229" for detecting, for example, the temperature of the circuit breaker and for driving the safety latch 223" to generate a signal for deactivating the interrupting control circuit in response to an abnormal temperature rise, whereby the power transmission is cut off to protect the circuit breaker from burning out.

Figure 13:
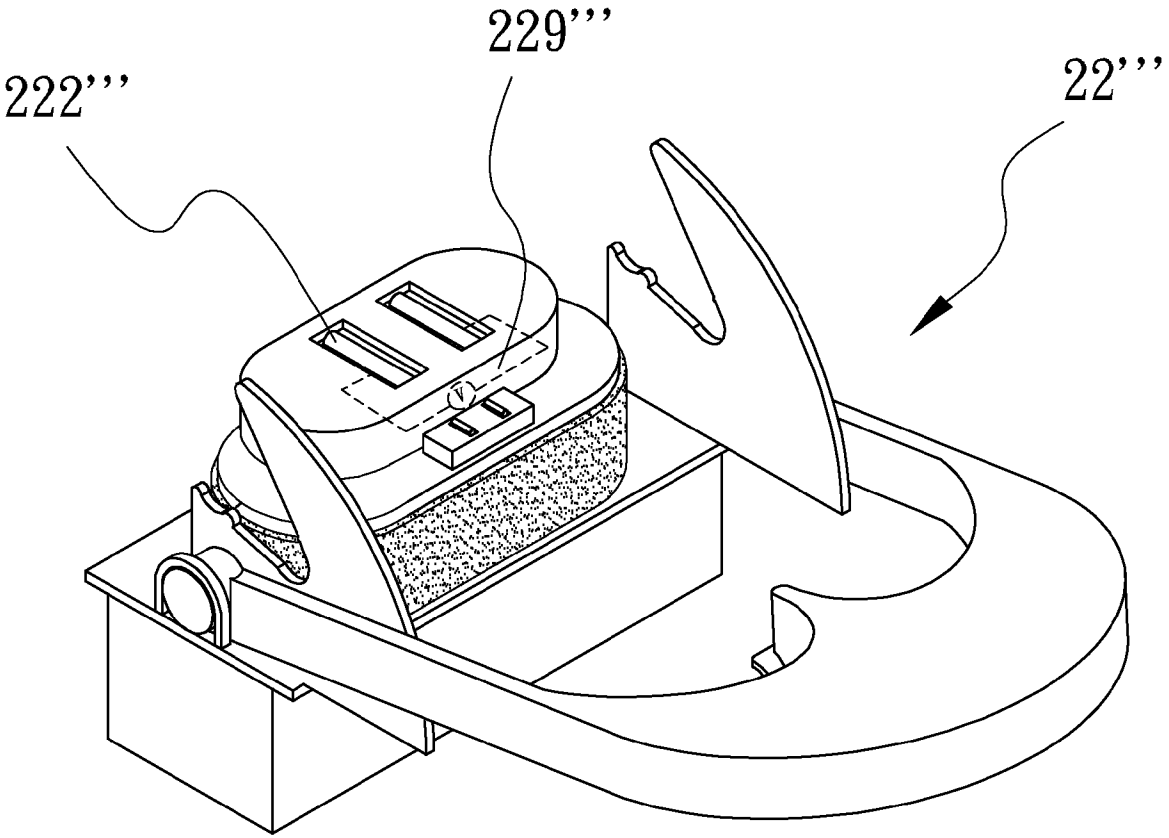
FIGS. 13 and 14 are schematic diagrams illustrating a circuit breaker for use in a high power system according to the fourth preferred embodiment of the invention.

It is apparent to those skilled in the art that the safety sensor unit described herein is not limited to a temperature sensor. As shown in FIG. 13, the two conductive terminals 222'" of the connecting device 22'" are connected to a voltmeter 229'" for measuring any voltage change resulted from an increase in value of electrical resistance between the conductive element of the switch device (not shown) and the conductive terminals 222'". When the voltage change reaches a predetermined level, the safety latch is immediately rendered to interact with the interrupting control circuit, so that the power transmission is cut off to ensure safety.

Figure 14:
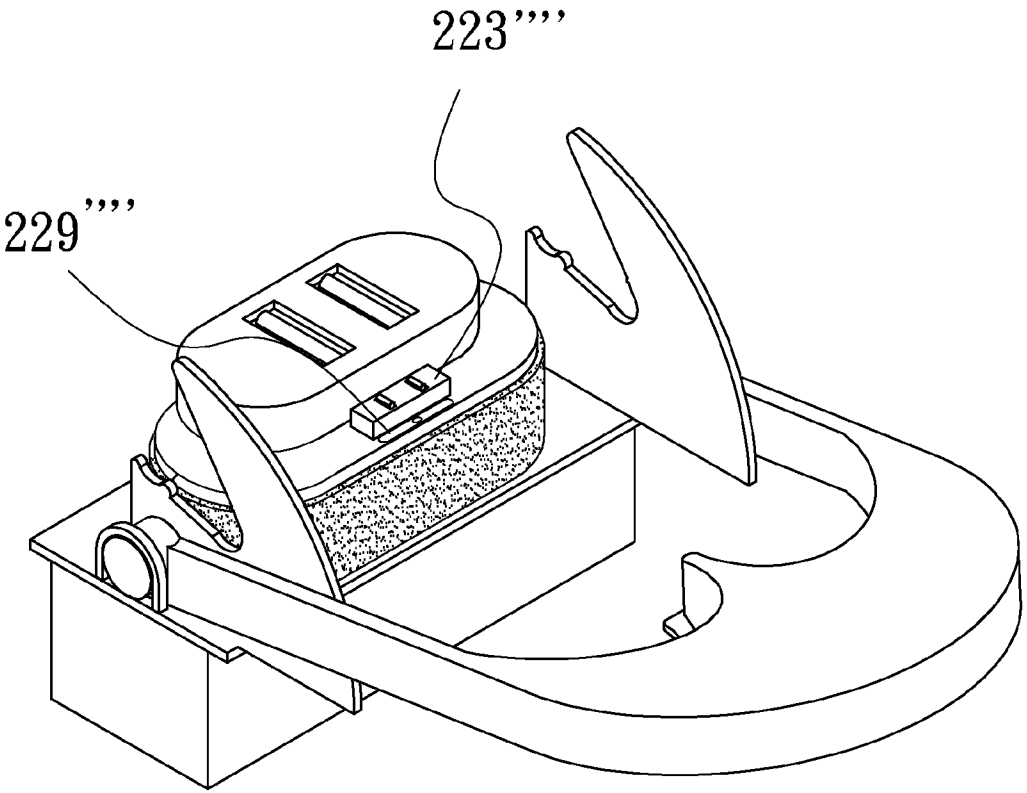

In addition, in the case where the circuit breaker and the power source connected thereto are installed in an electric vehicle, it would be desirable to cut off power transmission if the vehicle tilts or even overturns due to an accident or other causes, so as to avoid the occurrence of additional risks in the batteries which serve as the power source. As shown in FIG. 14, a safety latch 223"" is provided in its circuit with a tilt sensor 229"" for measuring the tilt level of the vehicle to determine if the power source should be deactivated. The safety sensor unit is optionally configured in the form of an ohm meter for measuring the resistance change in the circuit, an accelerometer for detecting whether the vehicle is subjected to an impact load or a moisture sensor for detecting water seepage, so as to ensure the safety of the power source in conjunction with the circuit breaker according to the invention.

According to the invention, the inventive circuit breaker may be used in conjunction with a battery unit. At the present time, an electric vehicle is normally provided with a battery unit comprised of hundreds of battery cells and further formed on its outer surface with a charging port configured like a refuel port. When the power level is reduced, the vehicle can be charged via by a charging gun provided at a charging station. In this case, the circuit breaker according to the invention may serve as a charging port connector and a charging gun.

Figure 15:
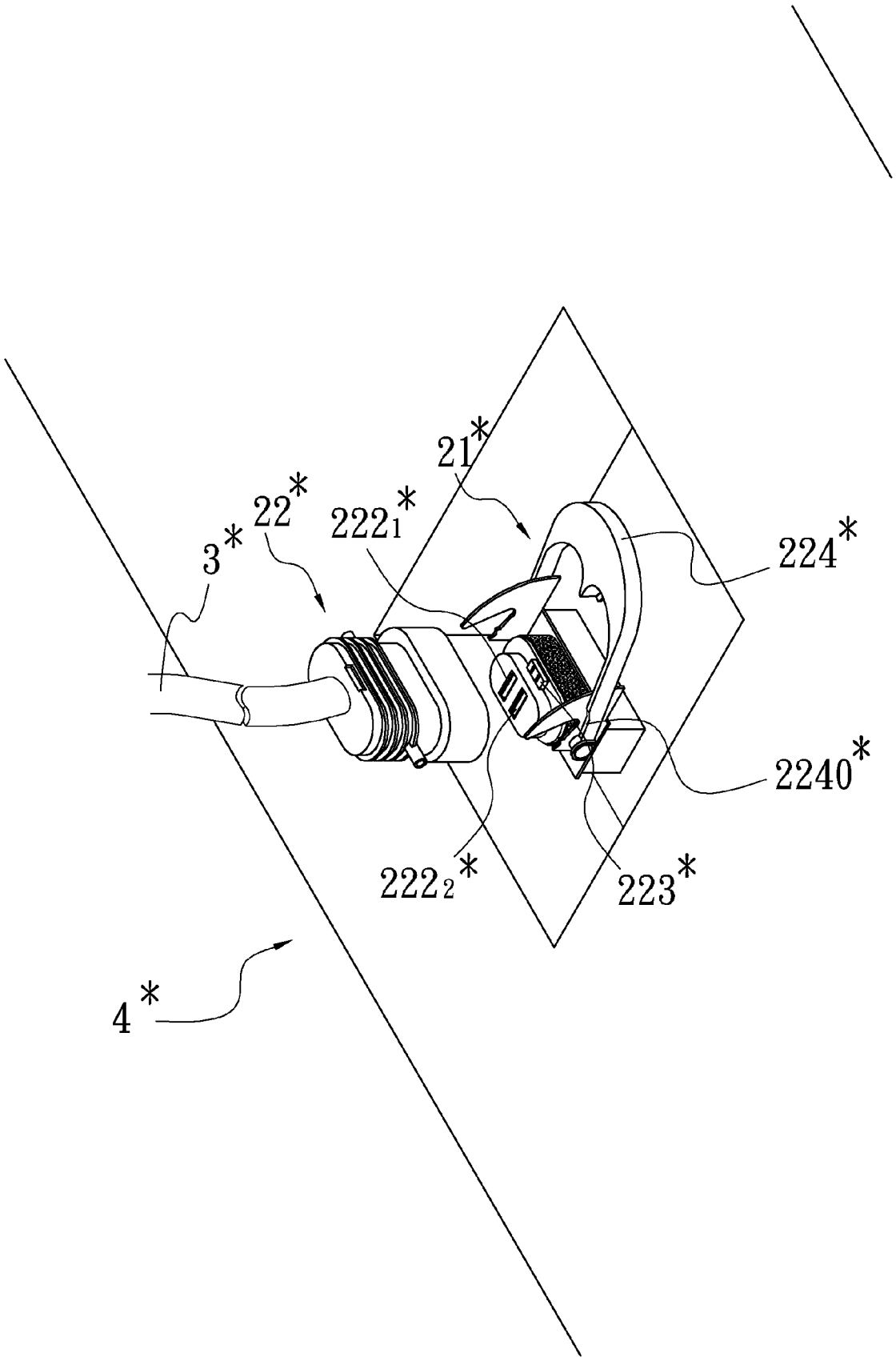
FIGS. 15 and 16 are schematic diagrams illustrating a circuit breaker for use in a high power system according to the fifth preferred embodiment of the invention.
Figure 16:
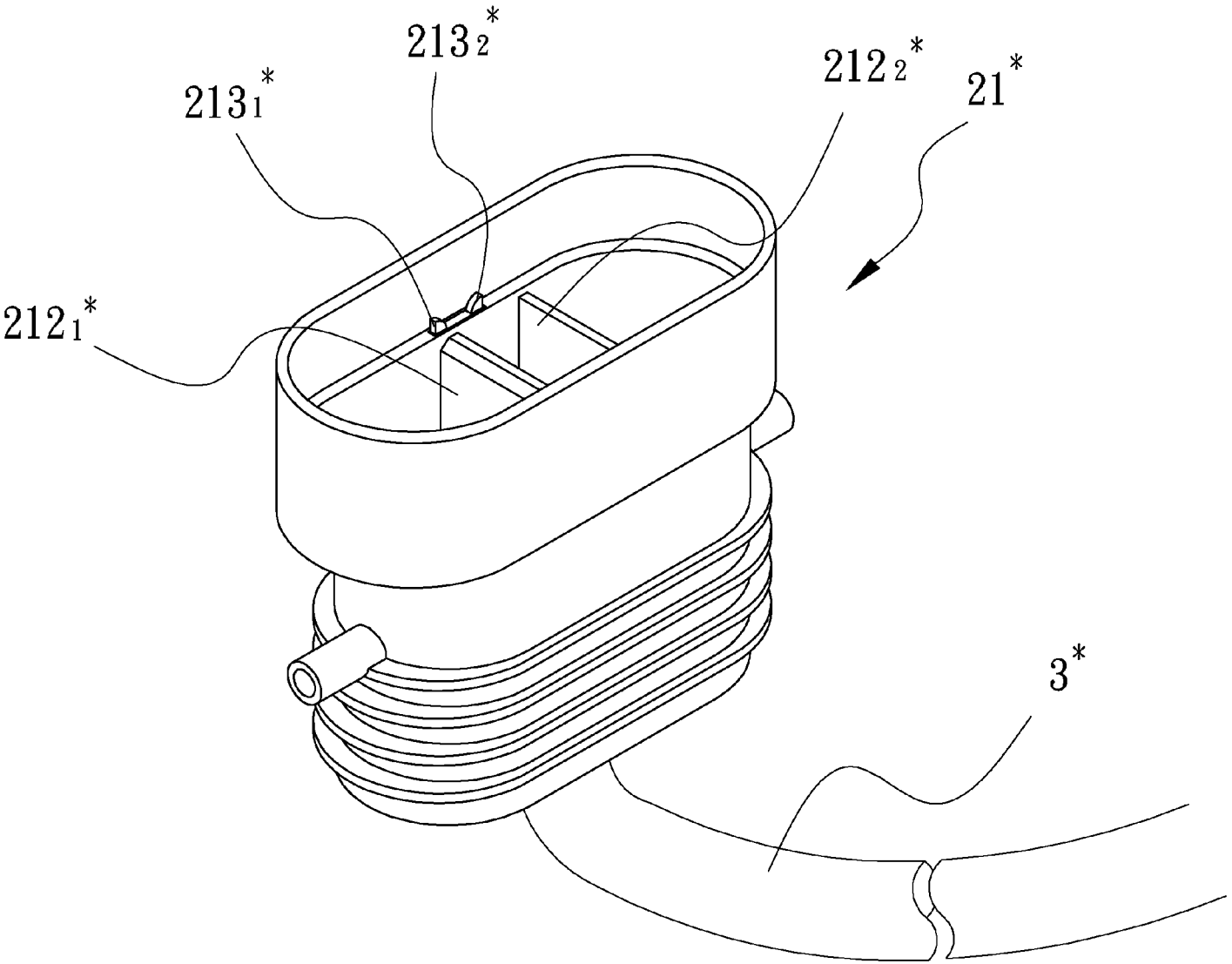

According to the fifth preferred embodiment shown in FIGS. 15 and 16, a connecting device 22* is employed as a charging port connector for an electric-powered vehicle, while a switch device 21* acts as a charging gun electrically connected to a power source provided at a charging station via a wire set 3*. By virtue of receiving two discrete conductive blades 2121* and 2122* provided in the charging gun, the conductive terminals 2221* and 2222* of the battery unit (not shown) in a high power system may act to establish an electrical circuit between the battery unit and the power source provided at a charging station. In this embodiment, due to the variety of battery voltage and current setups in vehicles available from different manufacturers, the charging gun provided at the charging station should be connected to a control unit mounted in the vehicle to find out the battery requirements before charging starts. In this embodiment, the safety latch 223* is configured as a pair of conductive plates adapted for being connected to the control unit of the vehicle, whereas the latch releasing element 213* in the charging gun are in the form of conductive blades 2131* and 2132* corresponding to the conductive plates and therefore adaptable to a management system of the charging station, whereby the management system of the charging station can communicate with the control unit of the electric vehicle 4* through the connection of the conductive plates to the corresponding conductive blades, so as to share information and software and further determine the mode as to how the electric vehicle 4* is to be charged based on the information of the battery unit acquired from the electric vehicle 4*.

Especially, in order to avoid serious damages to either the charging gun or the vehicle caused by a careless driver who drives his vehicle away from the charging station without detaching the charging gun, the pressing holder 224* of the connecting device 22* is formed with a sacrificing section 2240* which is narrower in size and thus weaker than the rest parts of the pressing holder 224*. In the case where the switch device 21* is detached from the connecting device 22* in a brutal way, the weakened sacrificing section 2240* would fracture due to stress. This mechanism is used as a trade-off for the integrity of the charging gun, while protecting the housing of the connecting device 22* from damage. The fractured pressing holder 224* can simply be replaced with a new one. Alternatively, the invention may be implemented by providing the weakened portion on, for example, the housing of the connecting device.

According to the aforesaid disclosure, a high power system such as that composed of hundreds of battery cells can be readily used in conjunction with the inventive circuit breaker and presents the following advantages as compared to the prior art counterparts:

1. The assembling and dissembling of the circuit breaker can be done by simply snapping in or pulling out the pressing holder, leading to an enhancement in working efficiency.

2. The switch device is coupled in a sealing engagement to the connecting device, so as to achieve a waterproof rating of IP69K and prevent unintentional touch by a maintenance technician. Therefore, the invention has an advantage in avoiding faulty power supply to an electrical equipment due to water seepage and the possible safety risks caused thereby and ensuring the safety of personnel performing maintenance works.

3. The circuit breaker has a simple structure and, therefore, can be easily produced with low manufacture cost. This is especially advantageous for the switch device which requires frequent replacement and maintenance.

4. In particular, the connecting device is provided with a safety sensor unit for ensuring the operation safety of the power system after assembling of the circuit breaker. The safety sensor unit helps cutting off power transmission before the occurrence of danger, such that the invention can be reliably utilized in electric-powered vehicles which are required to meet an extremely high standard of safety factor.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit and scope of the invention.

What is claimed is:

1. A circuit breaker for use in a high power system by being connected in series to the high power system having an interrupting control circuit, the circuit breaker comprising:

a switch device, including:

a body formed with a rest portion;

a conductive element disposed in the body and having two protruding conductive plug parts; and a latch releasing element disposed in the body;

a connecting device, including:

a housing;

a socket having two receptacle holes formed in the housing, the receptacle holes being each provided inside with a conductive terminal for receiving and engaging the conductive plug part of the conductive element and for being connected in series to the high power system;

a safety latch adapted for activating the interrupting control circuit upon being driven by the latch releasing element, when the switch device is coupled to the connecting device to establish an electrical circuit between the conductive terminals and the conductive element; and a pressing holder disposed on the housing and adapted for pivoting about a pivot axis with respect to the housing, the pressing holder having a snap portion for being received by the rest portion in such a manner that the switch device is forcedly pressed against and combined with the connecting device;

wherein one of a portion of the body of the switch device where the conductive element is disposed and a portion of the housing of the connecting device where the socket is formed is configured in the form of a protrusion, while the other is configured in the form of a recess corresponding to the protrusion, and wherein the protrusion is sleeved outside with a flexible seal.

2. The circuit breaker according to claim 1, wherein the connecting device is further provided with a safety sensor unit for, upon detecting an abnormal condition, driving the safety latch to deactivate the interrupting control circuit.

3. The circuit breaker according to claim 2, wherein the safety sensor unit is a temperature sensor.

4. The circuit breaker according to claim 2, wherein the safety sensor unit is a voltmeter.

5. The circuit breaker according to claim 2, wherein the safety sensor unit is a tilt sensor.

6. The circuit breaker according to claim 1, wherein one of the body of the switch device and the pressing holder of the connecting device is formed with a plurality of lugs, while the other is formed with a plurality of guide portions, each corresponding to one of the lugs, and wherein the guide portions abut on and press against the lugs as the pressing holder is pivoted about the pivot axis, so that the switch device is forcedly pressed against the connecting device.

7. The circuit breaker according to claim 6, wherein the switch device is formed with two lugs and the guide portions are two tapered guide slots formed in the pressing holder in a manner corresponding to the two lugs.

8. The circuit breaker according to claim 1, wherein the latch releasing element and the conductive element are disposed together in the protrusion/recess.

9. The circuit breaker according to claim 1, wherein the latch releasing element is a conductive blade, and wherein the safety latch is configured as two conductive wires electrically connected to the interrupting control circuit, respectively, so as to transmit a signal demanding the establishment of electrical connection to the interrupting control circuit as the conductive blade is brought in contact with the conductive wires.

10. The circuit breaker according to claim 1, wherein the latch releasing element is an abutting portion and the safety latch is a pressure-sensitive sensor.

11. The circuit breaker according to claim 1, wherein the flexible seal is a rubber ring, so that the switch device is coupled to the connecting device with a waterproof rating of IP69K.

12. The circuit breaker according to claim 1, wherein the latch releasing element is much smaller in size as compared to the conductive element and is disposed aside the conductive element, so as to avoid mis-assembly of the switch device with the connecting device.

13. The circuit breaker according to claim 1, wherein when the switch device is in a detached condition from the connecting device, the distance between the latch releasing element and the safety latch is larger than that between the conductive element and the conductive terminals.

14. A high power system provided with a circuit breaker, comprising:

a power source;

an interrupting control circuit for controlling the power source;

a circuit breaker connected in series to the power source, comprising:

a switch device, including:

a body formed with a rest portion;

a conductive element disposed in the body and having two protruding conductive plug parts; and a latch releasing element disposed in the body;

a connecting device, including:

a housing;

a socket having two receptacle holes formed in the housing, the receptacle holes being each provided inside with a conductive terminal for receiving and engaging the conductive plug part of the conductive element and for being connected in series to the high power system;

a safety latch adapted for activating the interrupting control circuit upon being driven by the latch releasing element, when the switch device is coupled to the connecting device to establish an electrical circuit between the conductive terminals and the conductive element; and a pressing holder disposed on the housing and adapted for pivoting about a pivot axis with respect to the housing, the pressing holder having a snap portion for being received by the rest portion in such a manner that the switch device is forcedly pressed against and combined with the connecting device;

wherein one of a portion of the body of the switch device where the conductive element is disposed and a portion of the housing of the connecting device where the socket is formed is configured in the form of a protrusion, while the other is configured in the form of a recess corresponding to the protrusion, and wherein the protrusion is sleeved outside with a flexible seal.

15. The high power system according to claim 14, wherein the connecting device of the circuit breaker is further provided with a safety sensor unit for, upon detecting an abnormal condition, driving the safety latch to deactivate the interrupting control circuit.

16. The high power system according to claim 14, wherein the power source is a plurality of rechargeable cells connected in series.

17. The high power system according to claim 14, wherein the switch device is formed with two lugs and the pressing holder is formed with two tapered guide slots corresponding to the two lugs, and wherein the tapered guide slots abut on and press against the lugs as the pressing holder is pivoted about the pivot axis, so that the switch device is forcedly pressed against the connecting device, and wherein the latch releasing element is a conductive blade and the safety latch is configured as two conductive wires electrically connected to the interrupting control circuit, respectively, so as to transmit a signal demanding the establishment of electrical connection to the interrupting control circuit as the conductive blade is brought in contact with the conductive wires.

18. The high power system according to claim 14, wherein the pressing holder has a weakened sacrificing section.

19. The high power system according to claim 14, wherein the latch releasing element includes two conductive blades, while the safety latch is configured in the form of two conductive plates corresponding to the conductive blades, respectively, and adapted for receiving/transmitting information from the two conductive blades.

* * * * *